US005881665A

United States Patent [19]

Ratcliff

[11] Patent Number: 5,881,665

[45] Date of Patent: Mar. 16, 1999

[54] TOWABLE RECREATIONAL WATERCRAFT HAVING EFFECTIVE AND CONVENIENT STEERING SYSTEM

[76] Inventor: Russell W. Ratcliff, 2880 Winslow Ave., Helena, Mont. 59601

[21] Appl. No.: 4,027

[22] Filed: Jan. 7, 1998

[51] Int. Cl.[6] ..... B63H 25/00

[52] U.S. Cl. ..... 114/246; 114/253; 441/65

[58] Field of Search ..... 441/65, 74; 114/242, 114/246, 253

[56] References Cited

U.S. PATENT DOCUMENTS

| | | | |
|---|---|---|---|
| 398,631 | 2/1889 | Lassoe | 114/246 |
| 2,568,549 | 9/1951 | Klutz | 114/246 |
| 3,626,428 | 12/1971 | Collare . | |
| 4,249,324 | 2/1981 | Latimer | 114/246 |
| 4,302,858 | 12/1981 | Casciano . | |
| 4,756,700 | 7/1988 | Coleman . | |
| 5,076,189 | 12/1991 | Jones . | |
| 5,462,001 | 10/1995 | Lemelson . | |

*Primary Examiner*—Ed L. Swinehart

[57] ABSTRACT

A towable watercraft is provided with a tow bar which extends over a front portion of a hull of the watercraft, and downwardly along the outside of the hull front portion to an elevation where a tow line can be secured to an end portion of the tow bar. A steering system operates the tow bar to pivot the tow bar and the hull relative to each other as the watercraft is being towed. The steering system includes a steering column turned by a steering wheel or bar, a steering drive shaft secured to the tow bar and pivotally supported relative to the hull, and a gear mechanism or a pulley mechanism linking the steering column and the steering drive shaft and providing a substantial mechanical advantage. A housing is provided for the steering system to contain the drive shaft and the linking mechanism.

25 Claims, 8 Drawing Sheets

TOWABLE RECREATIONAL WATERCRAFT HAVING EFFECTIVE AND CONVENIENT STEERING SYSTEM

BACKGROUND OF THE INVENTION

The present invention relates to a towable watercraft, and more particularly to systems and methods for steering a watercraft as the craft is being towed by a moving boat.

Motorboats can tow various kinds of water devices in providing water recreation for users of the devices. In the case of water skis, the water skier normally stands on the skis and holds a tow rope connected to a boat to be pulled forward under the driving force of the boat. The skier can maneuver back and forth across the wake of the boat by weight shifting and tow rope positioning, and thereby achieve greater enjoyment from the water skiing experience. A rider on a towed wakeboard faces similar maneuvering requirements during towing.

However, water skiing or wakeboarding requires use of personal maneuvering skills and places substantial physical demands on the skier or wakeboarder. As a result, the sport of towed water skiing or wakeboarding has somewhat limited participation.

Other types of towable watercraft facilitate wider participation in recreational watercraft towing. For example, aquaplanes, hydrofoils, inflatable watercraft, and the like free the rider from most physical demands with lower skill requirements, but they normally have little or no steering capability.

Water sleds, small boat-like craft, and other types of towable watercraft also typically impose reduced physical demands and reduced maneuvering skill requirements on a rider. Some prior art watercraft of these types have employed some forms of steering control, but such steering has been limited in effectiveness.

In a towable watercraft having a conventional rudder-type steering system, a steering mechanism is operated to pivot one or more rudders thereby producing water forces on the underside of the craft which change the direction in which the craft is moving subject to tow line limits. However, the rudder-type steering system has limited effectiveness due to relatively poor steering power and relatively slow steering response time. U.S. Pat. No. 5,462,001, entitled TOWED WATERCRAFT AND STEERING METHOD, and issued to J. H. Lemelson on Oct. 31, 1995 discloses an exemplary rudder type steering system.

U.S. Pat. No. 4,302,858, entitled STEERABLE TOWED VEHICLE, and issued to F. M. Casciano on Dec. 1, 1981, discloses another type of steering system in which a control rope is extended to the underside of the vehicle where it is attached to a tow rope used to pull the vehicle. A rider on the vehicle uses a handle to pull or release the control rope, thereby pivoting the tow rope about its point of attachment to the back of the vehicle. The tow rope applies steering forces to the vehicle according to the extent of pivotal movement of the tow rope.

Even if the Casciano system provides some increase in steering response speed relative to rudder-type steering systems, this system operates with little or no mechanical advantage and places significant physical demands on the rider during steering operations.

In view of the state of the prior art, a need exists for a towable watercraft which can be conveniently and effectively steered by a rider substantially without requiring special rider operating skills and without placing objectionable physical demands on the rider.

SUMMARY OF THE INVENTION

In accordance with the invention, a towable watercraft comprises an elongated body member having a front portion and having a rear portion where a rider can be positioned. An elongated tow mechanism is located in the front body portion for attachment to a tow line. Means are provided for steering the watercraft, including means for supporting the tow mechanism for pivotal movement relative to the watercraft body.

The supporting means is driven by driving means to pivot the tow mechanism and the watercraft relative to each other thereby steering the watercraft when it is being towed. A steering control mechanism is coupled to the tow-mechanism supporting means by a coupling mechanism which provides a substantial mechanical advantage for the rider in operating the steering control mechanism.

The invention further relates to methods for steering towable watercraft structured as described above.

BRIEF DESCRIPTION OF THE DRAWINGS

The accompanying drawings, which are incorporated in and constitute a part of this specification, illustrate a preferred embodiment of the invention and together with the description provide an explanation of the objects, advantages, and principles of the invention. In the drawings.

DESCRIPTION OF THE PREFERRED EMBODIMENT

The present invention is directed to a towable watercraft having a steering system with a pivotally mounted tow mechanism or tow bar. A user turns the tow mechanism and the craft, as the craft is being towed, by operating a steering control which is coupled to the tow mechanism through a linkage structure providing significant mechanical advantage. The watercraft may be any of a variety of conventional types.

Figure 1:
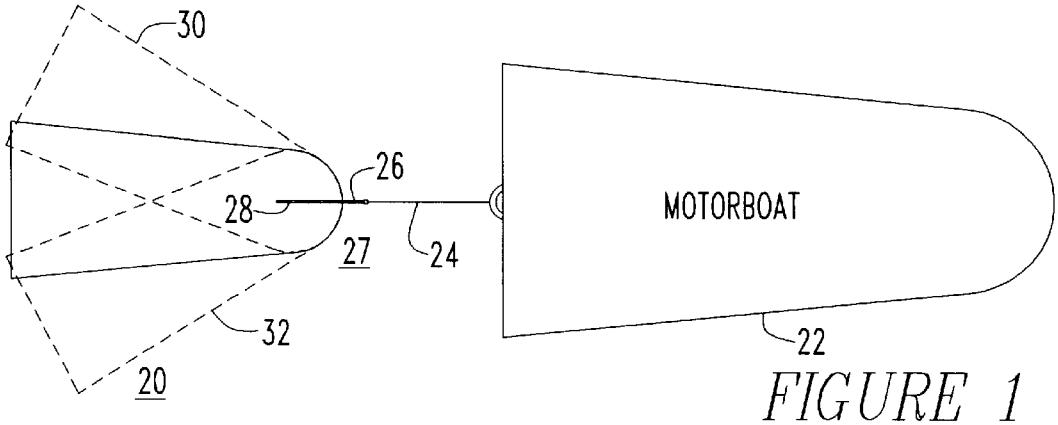
FIG. 1 is a schematic diagram showing a motorboat towing a watercraft provided with a first embodiment of a steering system of the invention in which the angular direction of a tow bar is used to translate a rider's steering forces into turning forces on the towed watercraft.

As shown in FIG. 1, a towable watercraft 20 of the invention is coupled to a motorboat 22, or the like, through a tow line 24. The watercraft 20 can be any of a variety of watercraft types including small boat-like units, water sleds, aquaplanes, hydrofoils, inflatable watercraft, etc.

The tow line 24 extends from the motorboat 22 and is secured to a tow mechanism 26, preferably in the form of a tow bar, located in or on a bow or front portion of the towable watercraft 20. The tow mechanism 26 forms a portion of steering system 27 for the towable watercraft 22, and it is pivotally supported within or on the front portion of the towable watercraft 20 as indicated by the reference character 28.

When the steering system 27 produces relative pivotal movement between the mechanism 26 and the watercraft 22 for right steering, the tow-line pulling force keeps the tow mechanism 26 in alignment with the tow line 24 and the watercraft 20 pivots in the clockwise direction about the pivot point 28 as indicated by dotted outline 30. Thus, the towable watercraft 20 turns to the right.

Conversely, the watercraft 20 pivots in the counterclockwise direction about the pivot point 28 as indicated by dotted outline 32 when the steering system 27 produces relative pivotal movement between the tow mechanism 26 and the watercraft 22 for left steering. Accordingly, the watercraft 22 turns to the left.

Hereinafter, to facilitate this description, pivoting of the tow mechanism (or bar) to the left or to the right is intended to include in its meaning the fact that the watercraft actually pivots, about the watercraft/tow mechanism pivot point, clockwise to the left or counterclockwise to the right of the tow mechanism when the watercraft is steered during towing.

In view of the relative pivotal movement between the tow bar 26 and the watercraft 22 as described, if a steering wheel or bar is used for steering control, it is desirable that the steering system be structured so that turning of the steering wheel or bar to the right causes the tow mechanism 26 to pivot oppositely to the left and turning of the steering wheel to the left causes the tow mechanism 26 to pivot oppositely to the right.

Figure 2:
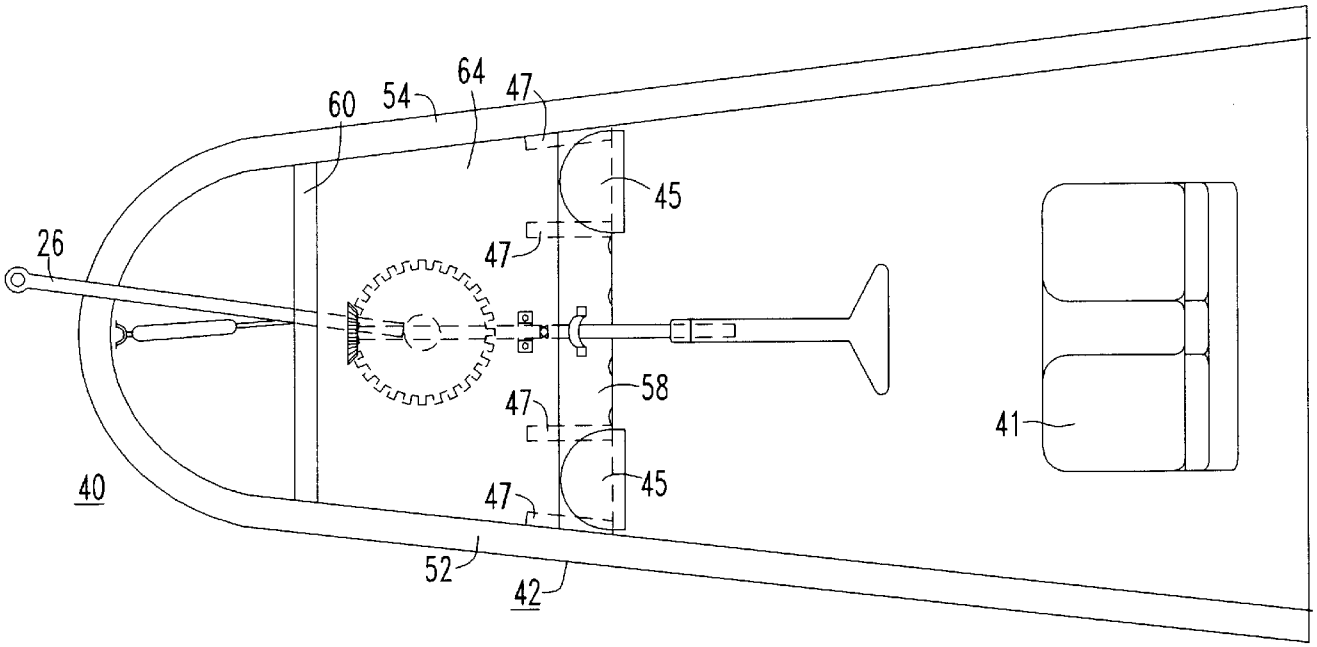
FIG. 2 is a schematic representation of an enlarged top plan view of the towable watercraft of FIG. 1 showing the steering system of the invention in greater detail.
Figure 3:
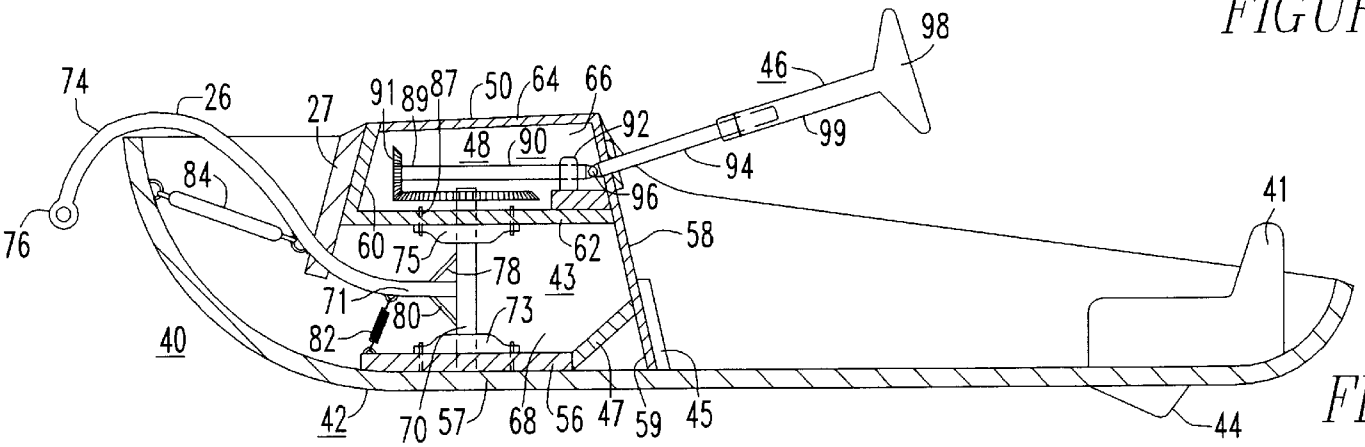
FIG. 3 shows a vertical longitudinal section along a longitudinal axis of the craft of FIG. 2.

The towable watercraft of the invention is embodied as a small, towable, boat-like unit 40 having a hull 42 and a steering system 43 as shown in FIGS. 2 and 3. In this towable watercraft embodiment, a seat 41 is provided for a rider to operate the watercraft 40 in a seated position. Padded foot braces 45, with associated supports 47, are provided for the seated rider. In other embodiments, provision can be made for the rider to stand or to kneel or to be positioned otherwise.

The hull 42 is preferably designed to facilitate maneuverability of the watercraft 40 as it is being towed. For example, a small keel 44 is provided in this case to prevent whipping on turns of the watercraft 40. Further, the bow portion of the hull 42 is structured to limit resistance to craft turning, thereby facilitating rider steering and supporting self-centering of the steering system 43. Structurally, the hull 42 can be formed as a fiberglass shell with foam filling.

A steering system of the invention, as embodied in the system 43 of FIGS. 2 and 3, includes the tow mechanism or bar 26 and a steering control 46 which is coupled to the tow bar 26 through a coupling structure 48 to provide a significant mechanical steering advantage for a rider when the watercraft 40 is being towed. The tow bar 26 preferably extends along a longitudinal centerline of the watercraft when it is centrally positioned.

A structurally secure steering system housing 50 extends across the watercraft 40 between side walls 52 and 54 of the hull 42. Coated and fiber-glass sealed marine plywood can be used to form structural parts of the steering housing which support the steering structure. Fiberglass or a high strength plastic can be used to form other housing parts.

In alternative embodiments of the invention in which the watercraft has an inflatable body, a steering system of the invention, including, for example, a tow bar, a steering control, a coupling structure, and a steering housing, can be appropriately secured to the uniflated watercraft body. The watercraft can thus be inflated to be ready for recreational use.

The steering housing 50 includes a base plate 56 which, in this case, is a separate housing part secured to a bottom 57 of the watercraft 40. A generally vertical housing facing wall 58 is secured to the bottom 57 and extends upwardly and forwardly from the bottom 57 to a top of the steering housing. The facing wall 58 further extends horizontally between, and is secured to, the side walls 52 and 53. Water is free to flow through drainage openings 59 in the facing wall 58 for discharge at the rear of the watercraft 40. The watercraft bottom 57 is preferably structured to provide a floor surface which slopes at least slightly downwardly toward the rear of the watercraft 40 for water discharge.

A front housing wall section 60 extends horizontally between, and is secured to, the hull side walls 52 and 54. The housing wall section 60 extends downwardly from the top of the steering housing 50 to a limited extent. A support plate 62 is secured to and extends horizontally between the wall section 60 and the facing wall 58 and between the hull side walls 52 and 54. A housing cover 64 extends across the space between the walls 52, 54, 58, and 60, and is preferably removably secured in place.

The elevation of the support plate 62 is set to provide an upper enclosed compartment 66 in which part of the mechanical coupling structure 48 of the steering system 43 are housed. A vertical, steering drive shaft 70 is located in a lower housing space 68 where it is securely connected to a rear tow bar portion 71 to apply pivoting forces to the tow bar 26 according to operation of the steering control 46. A lower end of the steering shaft 70 is bearing supported within a flange block 73 which is secured to the base plate 56.

Figure 9:
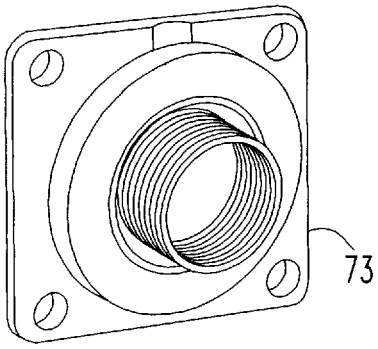
FIGS. 9–12 are perspective views of gear and block units employed in the steering system of the invention.

The flange block 73 is mounted horizontally to support the vertical steering drive shaft 70. If the shaft 70 is disposed in a tilted position, the flange block 73 is mounted on the base plate 56 at an angle corresponding to the angle of shaft tilt. An enlarged view of the flange block 73 is shown in FIG. 9.

An upper portion of the steering shaft 70 extends through an opening in the housing support plate 62 and is bearing supported relative to the plate 62 by means of another flange block 75 like the block 73. The flange block 75 is horizontally or angularly mounted as previously described.

Figure 10:
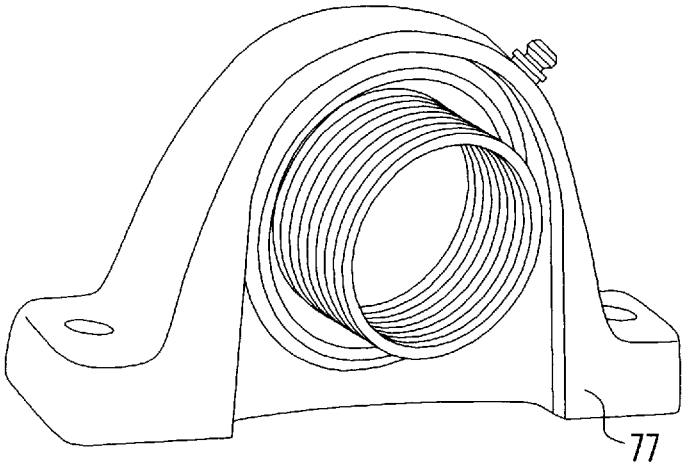

Alternatively, pillow blocks 77 (FIG. 10) can be employed in place of the flange blocks 73 and 75. When used in a towable watercraft of the invention, such pillow blocks 77 are suitably mounted at a right angle to the mounting angle of the flange blocks 73 and 75.

The tow bar 26 operates as a pulling and steering device for the watercraft 40. Generally, the tow bar 26 swings from side to side around the front of the watercraft 40, thereby moving the pull point and turning the watercraft 40 in the manner previously described. Rubber or other resilient bumpers 27 are provide on the side walls 52 and 54 to limit the angular movement of the tow rod 26 in the leftward and rightward directions.

Structurally, the tow bar 26 is sized and formed to withstand expected towing and steering forces. Further, the tow bar 26 is shaped along its length to extend forwardly from its secured pivot point (i.e., the drive shaft 70) and over the bow of the watercraft 40 so that it is free to swing from side to side as described above. Preferably, the tow bar 26 has a front end portion 74 which is bent over the bow of the watercraft 40 and downwardly so that a securance eye 76 for the tow line is located at an elevation most suitable for towing and steering in each application of the invention. If desired, a quick tow line release (not shown) can be provided at the location of the tow bar eye 76.

In at least some applications of the invention, the best location for the pull point (the tow bar eye 76) is just above the water line. In any case, the watercraft designer will set the pull point elevation with consideration of all other design parameters such that the watercraft operation is stable with high maneuverability.

When the watercraft 40 is being towed and it is desired to disable the steering function, such as when it is being towed without a rider, a lock 110 can be used to hold the tow bar 26 against pivoting motion. The lock 110 is a member which has a slotted top portion 112 secured to the steering housing as shown in the drawings by means of a bolt 114 and wing nut 116. Slightly raised housing lips 113 hold the lock 110 against rotation.

The lock 110 also has a U-shaped end portion which, in a locking position, fits about the tow bar 28 when the lock 110 is released to slide downwardly to the tow bar 26. The wing nut 116 is tightened to hold the lock 110 in the locking position and thereby prevent the tow bar 26 from pivoting.

As one lock alternative, the lock member can be hinged to the housing instead of being supported for sliding movement relative to the housing as described.

When the steering shaft 70 is vertical, as in the embodiment of FIG. 3, the tow rod 26, located on a longitudinal centerline of the watercraft 40, swings from side to side in a horizontal reference plane. In other embodiments, the steering shaft 70 can be tilted backwardly as indicated by dotted line 86 (FIG. 4) so that, with the tow rod 26 orthogonally secured to the shaft 70, a front pull point is higher than side pull points, and the tow rod 26 pivots in a corresponding reference plane upwardly tilted in the forward direction. The steering shaft 70 can also be tilted forwardly as indicated by dotted line 88 so that a front pull point is lower than side pull points, and the tow rod 26 pivots in a corresponding reference plane downwardly tilted in the forward direction.

A solid horizontal or tilted reference plane containing the best arc for pivoting the tow rod 26 depends primarily on the hull design. As the pull point of the tow bar 26 swings about the front of the watercraft 40, the tow bar 26 preferably moves in an arc enabling the pull point to maintain a level which causes neither top overturn forces nor excessive lifting forces on the watercraft. When the steering shaft 70 is disposed in a tilted position, all supports and other watercraft parts are appropriately structured to accomodate the tilted shaft.

When the invention is embodied with a tilted steering shaft, the watercraft pivots in a tilted solid reference plane during steering operations. Generally, the watercraft moves stably with such steering, and, in at least some embodiments, such steering can be the best way to vary the heights of the pull point to account for different drag forces at different pull points, i.e., at different angles between the tow bar and the watercraft centerline. Thus, when starting a turn, the watercraft of the invention experiences strong side pulling forces, such that a lower pull point for such strong forces can impart some lift to the watercraft somewhat and thereby prevent the watercraft from diving or tipping.

The tow bar 26 is securely supported relative to the steering drive shaft 70 by means of a suitable, strong direct connection to the shaft 70, and further by means of vertical support braces 78 and 80. A coil spring 82 is connected between the base plate 56 and the tow bar 26 to provide center-return forces to the tow bar 26 when the steering control 46 is released.

In addition, a hydraulic cylinder 84 is secured to the craft bottom 57 and connected to the tow rod 26 to dampen spring and other forces applied to the tow rod 26 in order to avoid whipping turns of the watercraft 40 which might otherwise throw the rider.

Figure 8A:
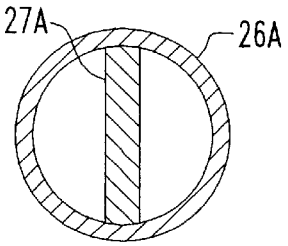
FIGS. 8A and 8B are cross-sections of alternative steering shafts for the steering system of the invention.
Figure 8B:
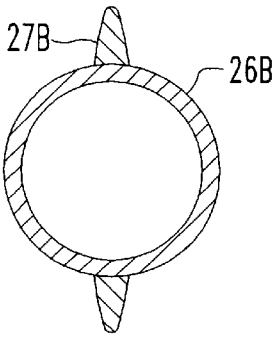

If the tow rod 26 is provided as a tubular member, it should be strengthened, as shown, for example in FIGS. 8A and 8B. Thus, a tow rod 26A has an inner partition wall 27A, and a tow rod 26B has external flanges 27B.

The steering coupling structure 48 of the steering system 43 is a mechanical coupling arrangement which may be embodied in various preferred forms, one of which, in the embodiment of FIG. 3, is a gear mechanism having a large horizontal bevel or miter gear 87 secured to the steering shaft 70 and a small, vertical bevel or miter gear 91 meshing with the large gear 87 and secured to a horizontal steering shaft 89 of a steering column 90 of the steering control 46. The opposite end of the horizontal steering shaft 89 is rotatively supported by a suitable support 92, such as a flange or pillow block which prevents longitudinal movement of the shaft 89.

Figure 11:
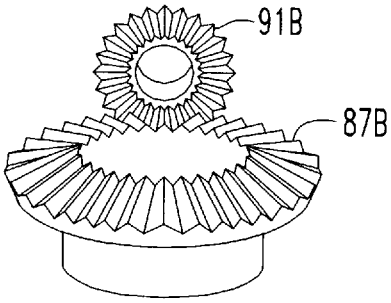
Figure 12:
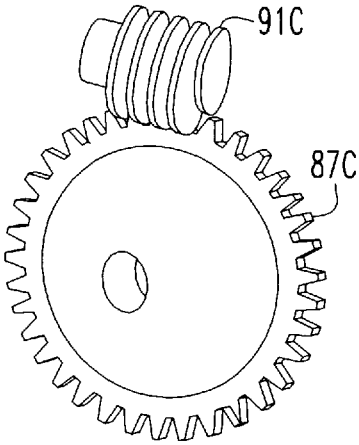

FIG. 11 illustrates exemplary bevel gears 87B and 91B. FIG. 12 shows exemplary worm gears 87C and 91C which may also be used in embodying the invention.

An upwardly angled steering column 94 is connected to the horizontal steering shaft 89 through one or more universal joints 96, with variable tilting provided by a tilting mechanism 95. A steering wheel 98, or other appropriate device such as a steering bar (not shown), and an adjustable length steering column extension 99 is provided at the upper end of the angled steering column 94. Significant mechanical advantage is provided by the steering system 43 as a result of the gearing ratio between the bevel gears 87 and 91.

Thus, the steering wheel or bar must be rotated multiple times to produce multiple rotations of the small gear leading to a partial turn of the large gear. The tow bar moves partially through its arc of motion with a partial turn of the large gear and the steering drive shaft. Hence, significant mechanical advantage is achieved.

The steering wheel 98 may be cone shaped and is structured to minimize resistance if the watercraft 40 overturns, and preferably has no holes, sharp corners, or other areas in or on which the rider might become entangled. The steering wheel size and the gear sizes are considered together in setting the steering ratio and associated mechanical advantage.

In FIG. 3, the small gear 91 is located above and forwardly of the large gear 87 to enable rightward turns of the steering wheel 98 to reverse the rotating direction of the steering shaft 70 and thereby produce leftward pivoting of the tow rod 26 and rightward steering of the watercraft 40 as previously described.

Figure 4:
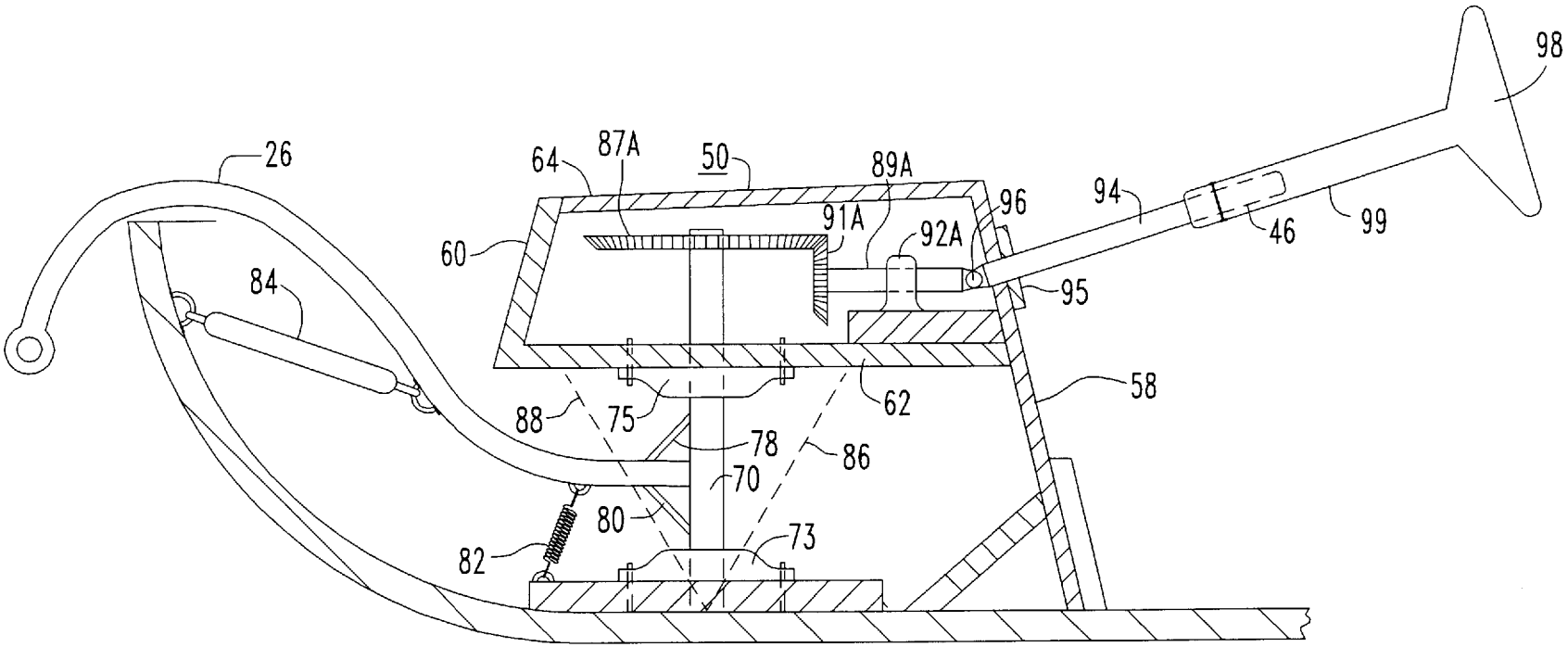
FIG. 4 is a partial longitudinal section of another watercraft which is similar to that of FIG. 3 but has a second embodiment of a steering system of the invention.

In FIG. 4, another embodiment of the invention is shown in which reference characters corresponding to those of FIG. 3 are employed. In this case the small gear 91A is located under and rearwardly of the large gear 87A to reverse the rotational direction of the steering shaft 70.

Figure 5:
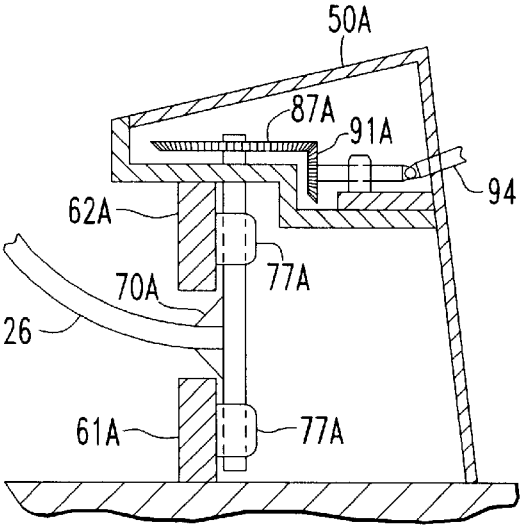
FIGS. 5–7 show additional embodiments of the invention in which variations in steering system support are provided.
Figure 6:
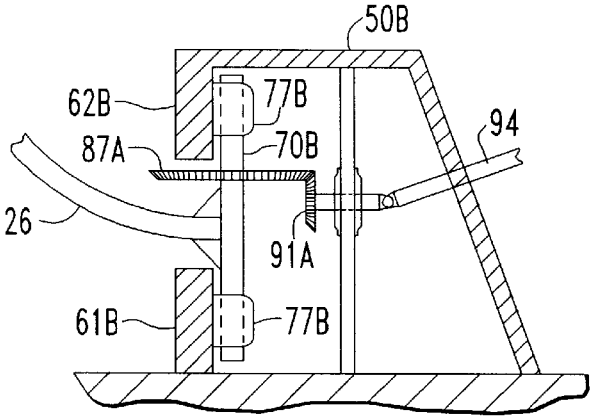
Figure 7:
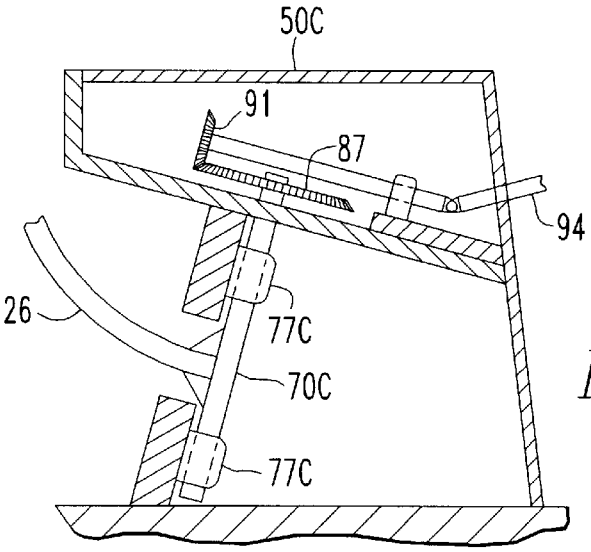

FIGS. 5–7 show further embodiments of steering systems of the invention. In FIG. 5, a housing 50A is structured to support a vertical steering drive shaft 70A by means of pillow blocks 77A secured to vertical housing blocks 61A and 62A. The gears 87A and 91A of FIG. 4 are employed to couple the steering control to the steering drive shaft 70A. The steering control structure is appropriately adapted to this embodiment.

In FIG. 6, a housing 50B has vertical blocks 61B and 62B which support a vertical steering drive shaft 70B by means of pillow blocks 77B. In this case, the gears 87A and 91A are located between the pillow blocks 77B. Again, the steering control structure is adapted to this embodiment.

FIG. 7 illustrates a tilted shaft version of the steering system like that designated by the dotted line 86 in FIG. 4. Thus, a housing 50C is structured to support a tilted steering drive shaft 70C by means of pillow blocks 77C. In this case, the gears 87 and 91 of FIG. 3 are employed, with the large gear 87 disposed at an angle which makes it orthogonal to the shaft 70C. The small gear 91 is meshed with the large gear 87 forwardly of the shaft 70C. The steering control structure is appropriately adapted to this embodiment.

In another embodiment (not shown), the steering shaft with the small gear can be disposed vertically in parallel with the vertical steering shaft 70 thereby placing both the small gear and the large gear meshed together in a solid horizontal reference plane. In this case, it is likely that multiple universal joints will be needed to place the steering wheel in a comfortable position for the rider.

Figure 13A:
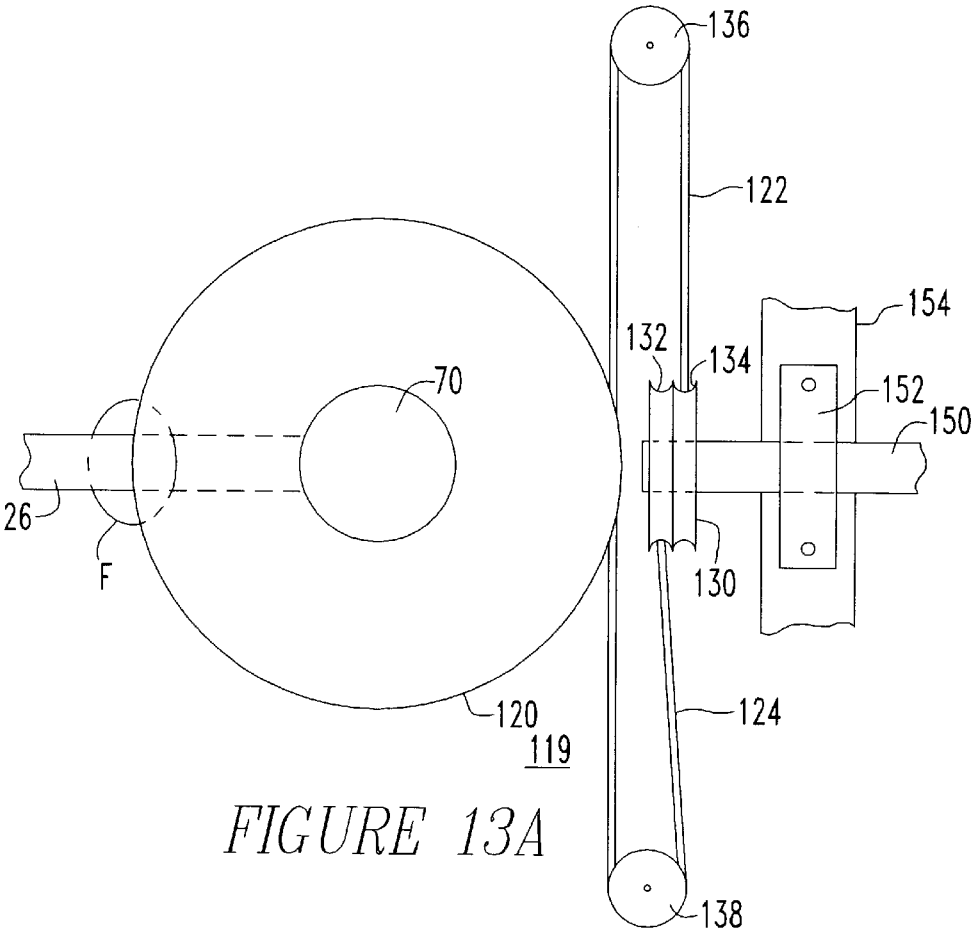
FIGS. 13A and 14 illustrate a further embodiment of a steering system of the invention in which a pulley system is used to transmit a rider's steering forces with mechanical advantage to a tow bar of the steering system.
Figure 13B:
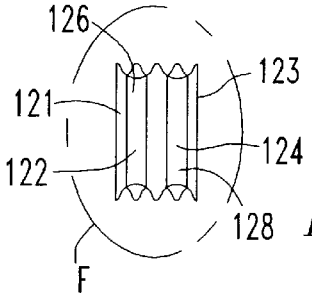
FIG. 13B is a partial end view of a large pulley in FIG. 13A.
Figure 14:
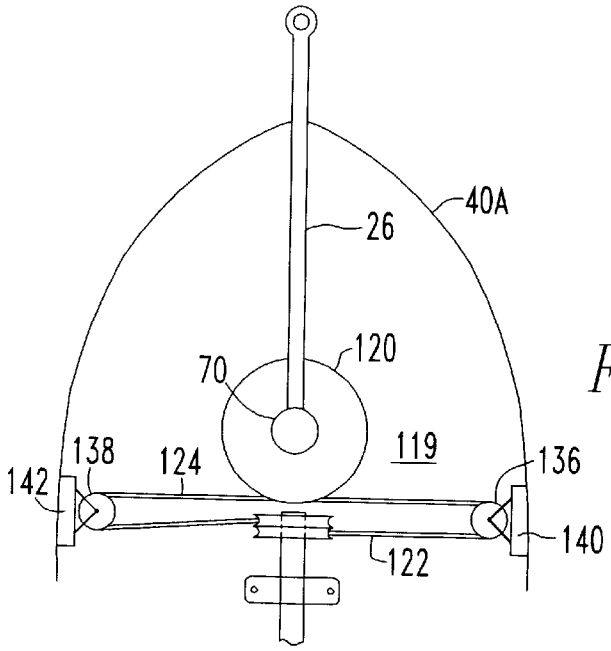
Figure 15:
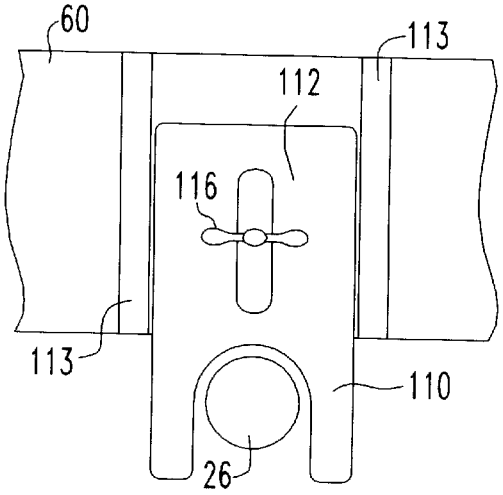
FIGS. 15 and 16 respectively show front and side views of a lock member which can be used to hold the watercraft steering system in a center position.
Figure 16:
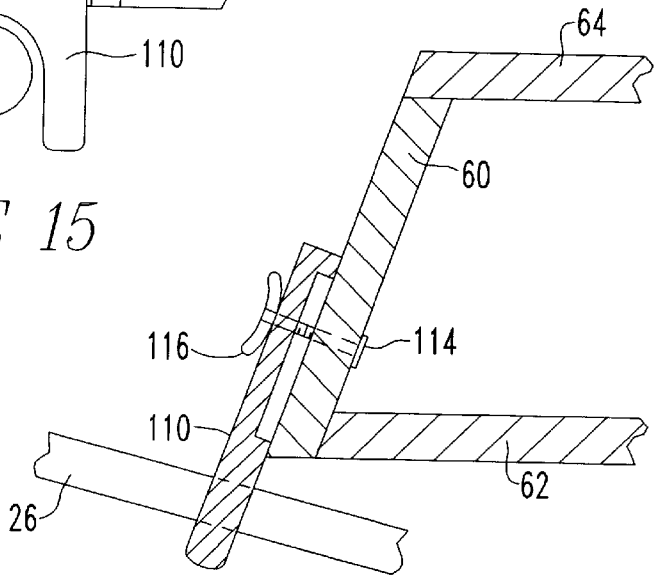
Figure 17A:
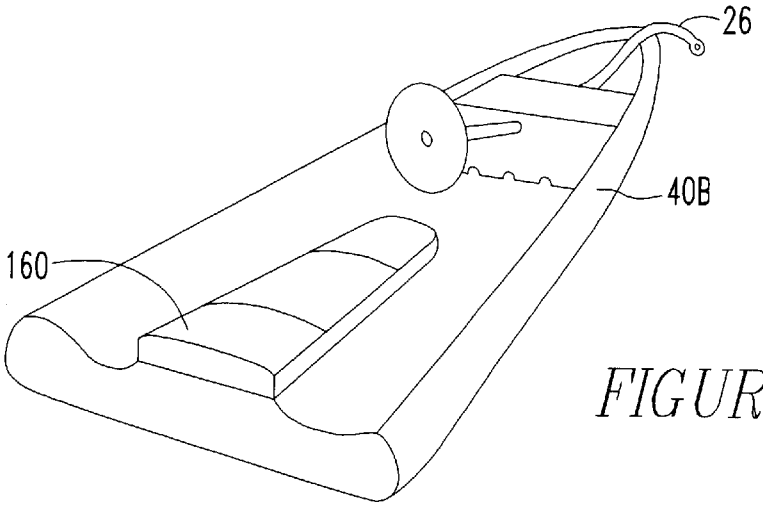
FIGS. 17A and 17B respectively show a perspective view and a top plan view of a watercraft of the invention in which provision is made for a rider to hold a kneeling position while being towed.
Figure 17B:
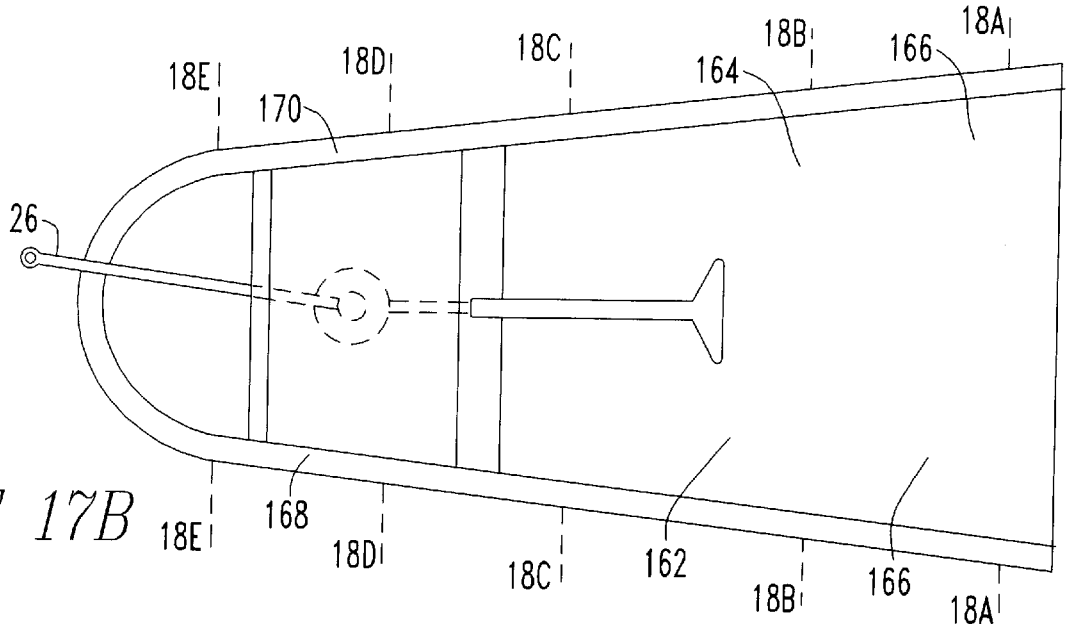

The coupling structure which ties the steering control with the tow mechanism or bar with a significant mechanical advantage can be provided in forms other than the described gearing mechanism. Another preferred mechanism is a pulley system 119, as shown for a watercraft 40A in FIGS. 13A, 13B, and 14.

A large drive pulley 120 having double grooves 121 and 123 is secured to the steering drive shaft 70, and respective cables 122 and 124 are located in the respective grooves 121 and 123 (FIG. 13B) and secured to the pulley 120 at a front end thereof, as indicated by reference characters 126 and 128. A steering takeup pulley 130 also has double grooves 132 and 134.

Ends of the cables 122 and 124 are secured to the takeup pulley 130, respectively in the grooves 132 and 134. The takeup pulley grooves provide sufficient room in width and depth to take up all of the cable being taken up in a full turn to either side (but limited as previously described). Thus, the cable lengths are set so that the cable let-out and pull-in amounts can be the same for the maximum allowed watercraft turn to either side.

Alternately, a single cable can be used between the drive pulley and the takeup pulley if sufficient friction exists on the takeup pulley to prevent or substantially limit slippage between successive wraps of cable when the takeup pulley is turned by the steering control.

In the two-cable embodiment, the cables 122 and 124 also respectively pass over single-groove directing pulleys 136 and 138 which rotate freely and are supported on opposite sides of the watercraft 40A as indicated by reference characters 140 and 142. The directing pulleys 136 and 138 can be mounted horizontally, as shown, vertically, or at any angle, to align the cables with the grooves in the drive and takeup pulleys.

Further, multiple pulleys can be used in place of each of the single directing pulleys 136 and 138, or the size of each of the pulleys 136 and 138 can be varied without affecting the mechanical advantage of the steering system. If desired, the directing pulleys 136 and 138 can be spring mounted to maintain cable tension.

In the steering control, a shaft 150 is secured to the takeup pulley 130 and supported by a pillow block 152 (or a flange block in other steering system designs) on a support 154. The remainder of the steering control includes a steering tilt mechanism, a u-joint, an adjustable steering column, and a steering wheel or bar as provided in previously described embodiments.

The described arrangement of the pulley system 119 facilitates design of the takeup/drive pulley ratio and the cable lengths to provide significant mechanical advantage in making watercraft turns within a specified allowable arc of watercraft turns.

FIGS. 17A and 17B and 18A–18E illustrate an embodiment of the invention in which a watercraft 40B is structured to enable a rider to kneel while being towed. The crosssectional views of FIGS. 18A–18E are taken from the indicated reference lines in FIG. 17B.

Figure 18E:
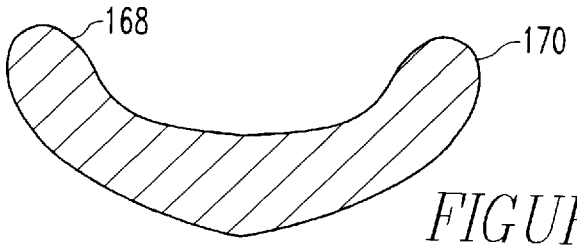
FIGS. 18A–18E are cross-sectional views taken along the reference lines indicated in FIG. 17B.
Figure 18D:
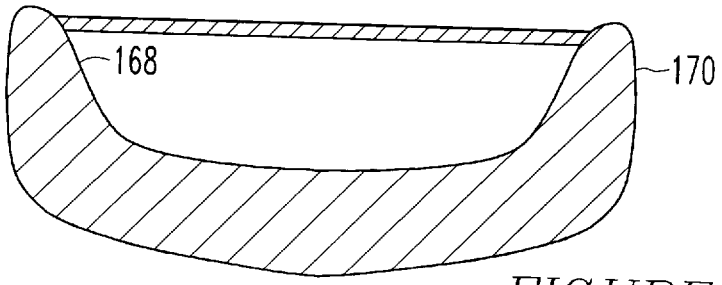
Figure 18C:
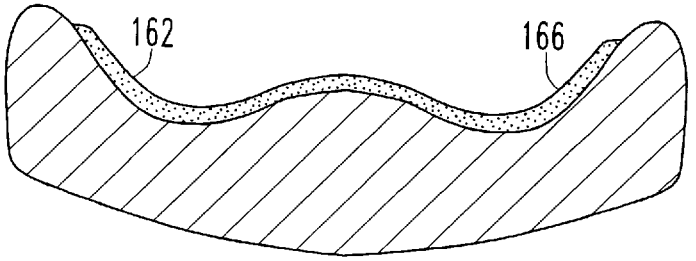
Figure 18B:
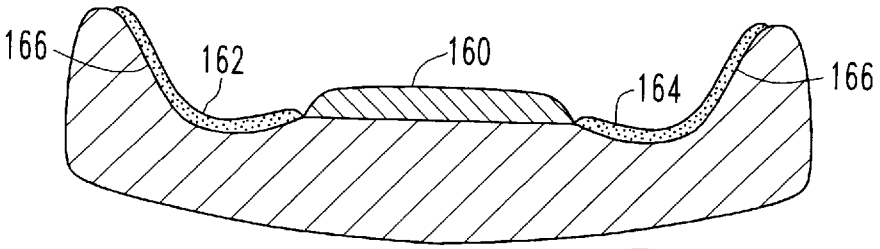
Figure 18A:
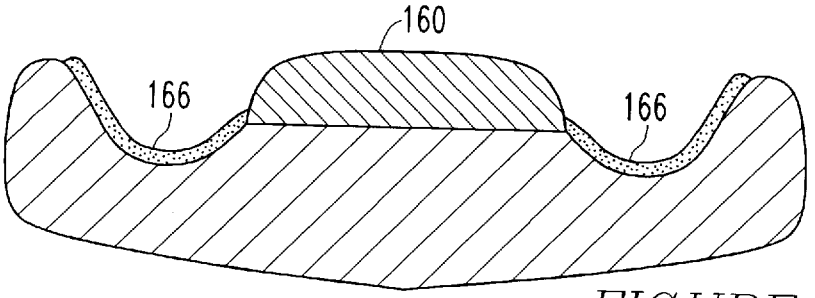

As shown, a kneeling cushion 160 is provided on a rear portion of the craft bottom. The rider's knees are supported in longitudinally extending, craft body grooves 162 and 164 which have a foam padding 166 as shown in FIG. 18B. The grooves 162 and 164 are sloped to drain water for discharge out of the back of the craft. Generally, the hull has a mostly flat bottom surface, especially toward its rear end. The bow is preferably narrowed, and preferably has a slight V-shaped bottom surface which blends in with the flat bottom surface. Side walls 168 and 170 of the watercraft are preferably higher from the front of the watercraft to the rearward end of the portion of the craft where the steering housing is located.

As described herein, the invention provides a towable watercraft having a steering system in which steering is accomplished by moving the tow point about the front and sides of the watercraft. Specifically, a tow line pulls a tow bar, and steering occurs as the tow bar and the watercraft are pivotally moved relative to each other, with the tow bar traversing an arc about the front and sides of the watercraft.

In the steering system, a steering drive shaft is secured to the tow bar and pivots on a bearing support in response to a steering control to apply forces to the tow bar which cause relative pivotal movement of the tow bar and the watercraft. Since the tow bar is held against angular movement by the pulling force of the tow line, the watercraft actually pivots around the steering drive shaft to produce the relative tow bar/watercraft movement, and the tow bar substantially always points toward the watercraft.

The steering control has a steering wheel or bar which is coupled to the steering drive shaft through a steering column and a gear or pulley system to provide significant mechanical advantage for the steering operation. The steering column is preferably adjustable in length and tilt according to a rider's preferences. A center-return mechanism preferably applies dampened spring return forces to the tow bar upon release of the steering control.

The invention provides a smooth and responsive way to steer a towed watercraft without requiring a rider to hold a tow line. Since the towed watercraft actually pivots about the pivot point, i.e., the steering drive shaft, a rider can start and sustain a watercraft turn without excessive drag like that which occurs in a watercraft having rudder steering. Overall, the steering mechanism of the invention, with its adjustment capabilities and its mechanical advantage, can be adapted to a wide variety of inflatable and/or rigid hull designs, and enables a rider to steer a watercraft with ease and comfort.

The foregoing description of the preferred embodiments has been presented to illustrate the invention without intent to be exhaustive or to limit the invention to the forms disclosed. In applying the invention, modifications and variations can be made by those skilled in the pertaining art without departing from the scope and spirit of the invention. It is intended that the scope and spirit of the invention be defined by the claims appended hereto, and their equivalents.

What is claimed is:

1. A towable watercraft comprising:

an elongated body member having a hull of predetermined design;

the body member having a front portion;

the body having a rear portion where a rider can be positioned;

an elongated tow mechanism located in the front body portion for attachment to a tow line;

means for steering the watercraft including means for supporting the tow mechanism for pivotal movement relative to the watercraft body;

means for driving the supporting means to pivot the tow mechanism and the watercraft relative to each other thereby steering the watercraft when it is being towed;

the driving means including a steering control mechanism; and a mechanism coupling the steering control and the tow-mechanism supporting means to provide a substantial mechanical advantage for the rider in operating the steering control mechanism.

2. The watercraft of claim 1 wherein the hull is a substantially rigid structure.

3. The watercraft of claim 1 wherein the elongated tow mechanism extends along a longitudinal centerline of the watercraft.

4. The watercraft of claim 1 wherein the the tow mechanism is an elongated bar which extends from a point at which it is supported along the front body portion, to an outer side of the front body portion such that an end bar portion is provided for securance of the tow line at an elevation determined to provide desired tow-operating characteristics for the watercraft.

5. The watercraft of claim 4 wherein the tow mechanism is a tow bar and the supporting means includes a steering drive shaft secured to the tow bar and bearing supported for pivotal movement relative to the body member.

6. The watercraft of claim 1 wherein the coupling mechanism is a gear system having a large gear secured to the tow-mechanism supporting means and a small gear meshed with the large gear and secured to the steering control mechanism.

7. The watercraft of claim 1 wherein the coupling mechanism is a pulley system having a large pulley secured to the tow-mechanism supporting means, a small pulley secured to the steering control mechanism, and a pulley cable secured to and connecting the large and small pulleys.

8. The watercraft of claim 3 wherein means are provided for returning the tow mechanism into substantial alignment with the longitudinal centerline after the driving means has driven the tow mechanism off the longitudinal centerline under steering mechanism control and the steering mechanism is released.

9. The watercraft of claim 8 wherein the returning means applies dampened spring return forces to the tow mechanism.

10. The watercraft of claim 9 wherein the returning means includes a return spring and a hydraulic cylinder secured to the tow mechanism and to the body member so that the return forces are applied to the tow mechanism as defined.

11. The watercraft of claim 9 wherein the tow mechanism is a tow bar and the supporting means includes a steering drive shaft bearing supported for pivotal movement relative to the body member and secured to the tow bar.

12. The watercraft of claim 3 wherein the coupling mechanism is a gear system having a large gear secured to the tow-mechanism supporting means and a small gear meshed with the large gear and secured to the steering control mechanism.

13. The watercraft of claim 3 wherein the coupling mechanism is a pulley system having a large pulley secured to the tow-mechanism supporting means, a small pulley secured to the steering control mechanism, and a pulley cable secured to and connecting the large and small pulleys.

14. The watercraft of claim 5 wherein the steering drive shaft is supported to extend substantially in the vertical direction and the coupling mechanism is formed by a system selected from a gear system and a pulley system.

15. The watercraft of claim 14 wherein the tow bar extends substantially along a longitudinal centerline of the watercraft, and a steering housing is secured to the body member and substantially contains the supporting means and the coupling mechanism.

16. The watercraft of claim 5 wherein the steering drive shaft is tilted at an angle from a vertical direction to provide an arc of tow-bar movement in a solid reference plane tilted from a horizontal reference plane.

17. The watercraft of claim 1 wherein the steering control mechanism includes a steering column having an end portion which can be grasped by the rider to turn the column and steer the watercraft through the coupling mechanism, the driving means, and the tow mechanism.

18. The watercraft of claim 17 wherein the coupling mechanism is structured to pivot the tow mechanism leftwardly when the steering control end portion is turned rightwardly and to pivot the tow mechanism rightwardly when the steering control is turned leftwardly.

19. The watercraft of claim 17 wherein:

the tow mechanism is a tow bar which extends substantially along a longitudinal centerline of the watercraft;

the supporting means includes a steering drive shaft secured to the tow bar and bearing supported for pivotal movement relative to the body member;

the coupling mechanism is a gear mechanism having a large bevel gear secured substantially perpendicularly to the drive shaft and a small bevel gear secured to the steering column and disposed substantially at right angles to, and above, and forwardly of and meshed with the large gear.

20. A steering mechanism for a towable watercraft comprising:

a housing adapted for securance to a body member of the watercraft;

an elongated tow mechanism projecting forwardly of the housing for extension over a front portion of the watercraft body member for securance to a tow line;

means for steering the watercraft including means for supporting the tow mechanism for pivotal movement relative to the housing;

means for driving the supporting means to pivot the tow mechanism and the housing relative to each other when the housing is secured to the watercraft body member and the watercraft is being towed;

the driving means including a steering control mechanism; and a mechanism coupling the steering control and the tow-mechanism supporting means to provide a substantial mechanical advantage for the rider in operating the steering control mechanism.

21. The steering mechanism of claim 20 wherein the tow mechanism is a tow bar and the supporting means includes a steering drive shaft secured to the tow bar and bearing supported by the housing for pivotal movement relative to the housing.

22. The steering mechanism of claim 20 wherein the tow bar and the drive shaft are substantially perpendicular to each other.

23. The steering mechanism of claim 21 wherein the coupling mechanism is a system selected from a gear system and a pulley system.

24. A method for steering a towable watercraft having a body member and a tow mechanism extending therefrom, the steps of the method comprising:

attaching a tow line to the tow mechanism;

operating a steering system to drive a shaft bearing supported by the body member and secured to the tow mechanism to move the tow mechanism and the watercraft pivotally relative to each other;

the operating step including operating a steering control mechanism to drive the shaft through a coupling mechanism which provides a substantial steering mechanical advantage.

25. The method of claim 24 wherein the tow mechanism is an elongated bar which extends substantially along a longitudinal centerline of the watercraft from a point at which it is supported by the drive shaft to an outer side of a front portion of the body member where an end bar portion is provided for securance of the tow line.

* * * * *